United States Patent [19]

Negishi

[11] Patent Number: 4,951,481

[45] Date of Patent: Aug. 28, 1990

[54] REFRIGERATOR WITH EFFICIENT COLD ACCUMULATOR

[75] Inventor: Kozaburo Negishi, Isesaki, Japan

[73] Assignee: Sanden Corporation, Japan

[21] Appl. No.: 324,028

[22] Filed: Mar. 16, 1989

[30] Foreign Application Priority Data

Mar. 17, 1988 [JP] Japan ..... 63-61762

[51] Int. Cl.[5] ..... F25D 17/04

[52] U.S. Cl. ..... 62/406; 62/430; 62/438; 62/439; 62/440

[58] Field of Search ..... 62/438, 430, 439, 440, 62/406, 434, 457, 407, 3.61, 3.62, 186, 518

[56] References Cited

U.S. PATENT DOCUMENTS

| | | | |
|---|---|---|---|
| 2,137,555 | 11/1938 | Young | 62/406 |
| 2,158,877 | 5/1939 | Limpert et al. | 62/518 |
| 2,191,198 | 2/1940 | Gould | 62/438 |
| 2,289,728 | 7/1942 | Rees | 62/438 X |
| 2,323,354 | 7/1943 | Rees | 62/438 X |
| 2,428,312 | 9/1947 | Herbener | 62/430 X |
| 2,534,272 | 12/1950 | Kleist | 62/439 X |
| 2,672,027 | 3/1954 | Wurtz | 62/518 X |
| 3,733,836 | 5/1973 | Corini | 62/3.61 |
| 3,747,364 | 7/1973 | Laing | 62/439 |

*Primary Examiner*—Lloyd L. King

*Attorney, Agent, or Firm*—Banner, Birch, McKie and Beckett

[57] ABSTRACT

A cold preserving container including an inner box forming a heat insulating chamber, an outer box, heat insulating material between the boxes, a cooling evaporating tube disposed on the outer surface of the inner box, and a cold accumulator enclosing a cold regenerative material and disposed between the evaporating tube and the heat insulating material. The cold accumulator directly contacts the evaporating tube substantially without any air therebetween and thus can be cooled rapidly and efficiently by the tube. The cold accumulator is disposed between the boxes, and thus its capacity can be easily increased, thereby increasing the cold preserving time of the container.

26 Claims, 3 Drawing Sheets

REFRIGERATOR WITH EFFICIENT COLD ACCUMULATOR

BACKGROUND OF THE INVENTION

1. Field of the Invention

The present invention relates to a cold preserving container or refrigerator which has means for cold accumulation.

2. Description of the Prior Art

Generally, a cold preserving container or refrigerator is constructed of an inner box defining a heat insulating chamber, an outer box covering the inner box and a heat insulating material provided between the inner box and the outer box.

As the means for actively cooling the inside of the heat insulating chamber or maintaining the cold air in the heat insulating chamber, the cooling mechanism assembled into the cold preserving container or the cold accumulation component including a cold regenerative material is known. The cooling mechanism comprises, for example, an evaporating tube through which an evaporated cooling medium circulates, a compressor, a condenser and an expansion valve. The evaporating tube can cool the inside of the heat insulating chamber, and can also cool the cold accumulation component. The cold accumulation component is usually placed between objects contained in the heat insulating chamber or at the upper position of the inside space of the chamber. Thus, the cold accumulation component is cooled via the cold air in the chamber, and the cold obtained by the cooling is accumulated in the component.

In such a cooling and accumulating mechanism, however, since the heat exchange is performed between the cold accumulation component and the cold air in the heat insulating chamber, the heat exchange is not very effective, and it takes a relatively long time to cool the component to the desired temperature. Therefore, it is difficult to quickly and adequately cool the cold accumulation component. On the other hand, when the component is adequately cooled, the temperature of the air in the heat insulating chamber is too low.

Moreover, since the cold accumulation component is placed in the heat insulating chamber, the size and capacity of the component is often thereby limited. Also, the time during which the contained objects can be maintained at a sufficiently low temperature is limited, for example, to only one to three hours.

SUMMARY OF THE INVENTION

Accordingly, an object of the present invention is to provide a cold preserving container or refrigerator which can cool a cold accumulation component rapidly and efficiently and can increase the capacity of the cold accumulation component easily without decreasing the inside capacity space of the container.

Directed to achieving this object, a cold preserving container is herein provided. The container includes a heat insulating chamber formed by an inner box defining the chamber, an outer box covering the inner box and heat insulating material between the inner box and the outer box. The inside of the heat insulating chamber is cooled by circulating a cooling medium through an evaporating tube disposed on an outer surface of the inner box. Also means for cold accumulation, enclosing a cold regenerative material, is disposed between the evaporating tube and the heat insulating material, covers the evaporating tube and is covered by the heat insulating material.

In the cold preserving container, since the cold accumulation means covers the evaporating tube and directly contacts the tube without any significant amount of air therebetween, the cold accumulation means can be rapidly and efficiently cooled by the tube and the inside of the heat insulating chamber is cooled by the tube. Moreover, since the cold accumulation means is covered with the heat insulating material, the cold regenerative material enclosed in the cold accumulation means can efficiently accumulate and hold cold. Accordingly, the cold accumulation means can be rapidly cooled to the desired temperature, and during this cooling, excessive cooling of the inside of the heat insulating chamber can be prevented.

Since the cold accumulation means is disposed between the inner box and the outer box, the capacity and size of the means is essentially independent of the capacity and size of the inside space of the heat insulating chamber. Therefore, the capacity of the cold accumulation means can be easily increased in comparison with that in the conventional container, thereby significantly increasing the cold preserving time of the container.

BRIEF DESCRIPTION OF THE DRAWINGS

Preferred exemplary embodiments of the invention will now be described with reference to the accompanying drawings which are given by way of example only, and thus are not intended to limit the present invention.

DETAILED DESCRIPTION OF PREFERRED EMBODIMENTS 0F THE PRESENT INVENTION

Figure 1:
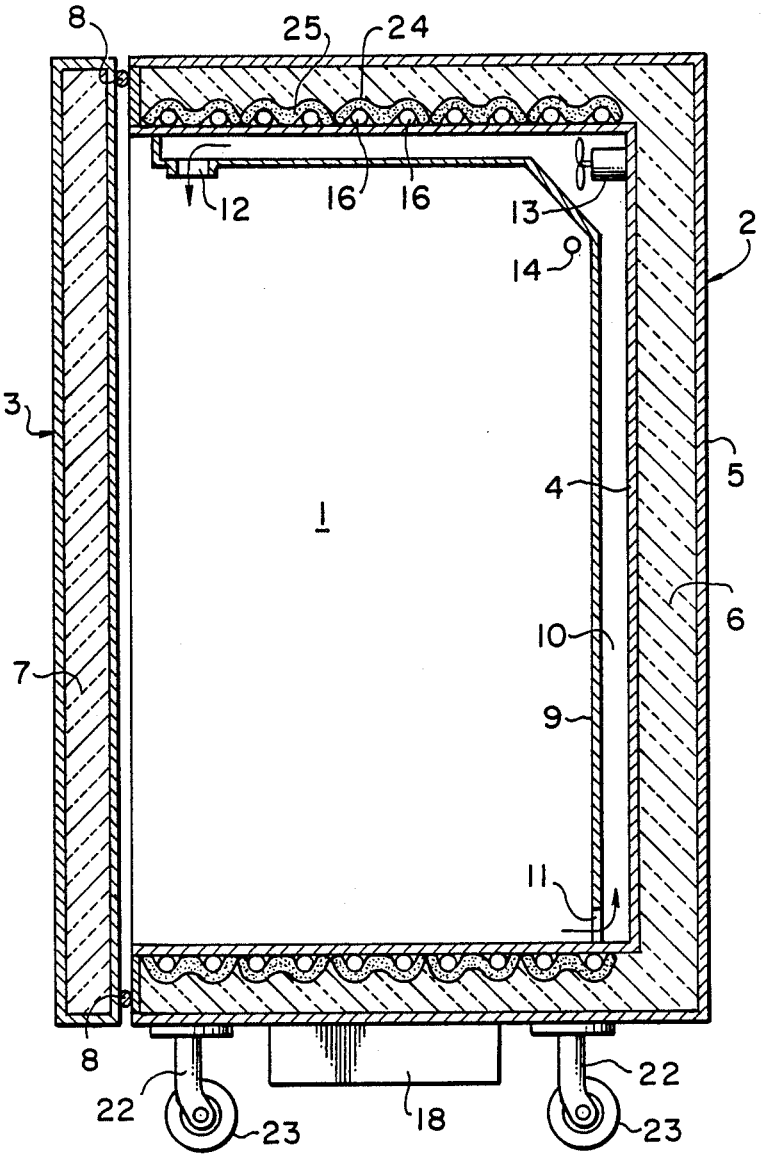
FIG. 1 is a vertical sectional view of a cold preserving container or refrigerator according to an embodiment of the present invention.

Referring to the drawings, FIGS. 1–6 illustrate a cold preserving container or refrigerator according to one embodiment of the present invention. The cold preserving container includes a heat insulating chamber 1 which is formed by a heat insulating box 2 and a door 3. Heat insulating box 2 is constructed of an inner box 4 defining heat insulating chamber 1, an outer box 5 covering the inner box and heat insulating material 6 filling the space between the inner box and the outer box. Door 3, which can be opened and closed, is attached to the front surface of heat insulating box 2. Heat insulating material 7 fills door 3. A packing 8 is attached to the back side surface of door 3 and provides a seal between the door and heat insulating box 2 when the door is closed.

A duct 9 attached to the inner surface of inner box 4 defines a cold air circulating path 10 along the inner surface of inner box 4. In this embodiment, cold air circulating path 10 extends along the inner back surface and the ceiling of inner box 4 and has an air inlet 11 at the bottom portion of the path and an air outlet 12 at an upper position of the inside of heat insulating chamber 1.

A circulation fan 13 in cold air circulating path 10 circulates the cold air in the heat insulating chamber 1 along the path. A thermostat 14 which is attached to the inner surface of inner box 4 measures the temperature of the air inside of heat insulating chamber 1. Circulation fan 13 is driven via a power circuit (not shown), and a signal from thermostat 14 is sent to the power circuit for driving the fan.

Figure 2:
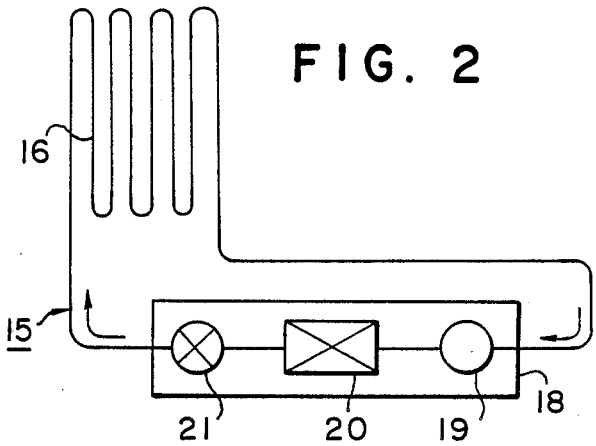
FIG. 2 is a schematic view of a cooling system assembled in the cold preserving container of FIG. 1.

Cooling means shown generally at 15 in FIG. 2 is assembled in the cold preserving container. Cooling means 15 comprises an evaporating tube 16 through which evaporated cooling medium 17 is circulated and a main unit 18 which comprises a compressor 19, a condenser 20 and an expansion valve 21. Main unit 18 is mounted on the bottom surface of heat insulating box 2, as shown in FIG. 1. Casters 22 with wheels 23 are also attached on this bottom surface.

The power for driving circulation fan 13 is obtained from a suitable external power unit (not shown) when an external power unit can be used, and obtained from a battery (not shown) built into the container when an external power unit cannot be used. This battery can be charged while cooling means 15 is driven, and circulation fan 13 can be driven while the battery is being charged.

Figure 3:
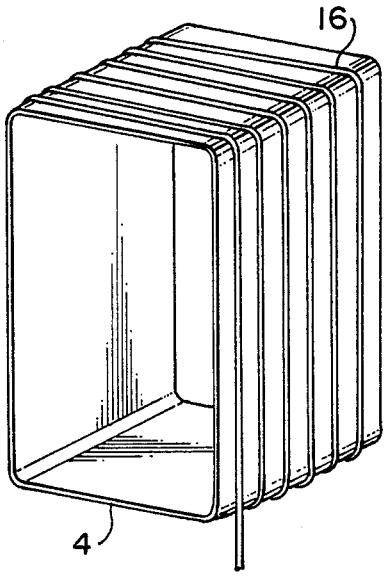
FIG. 3 is a perspective view of an inner box and an evaporating tube of the cold preserving container of FIG. 1.
Figure 7:
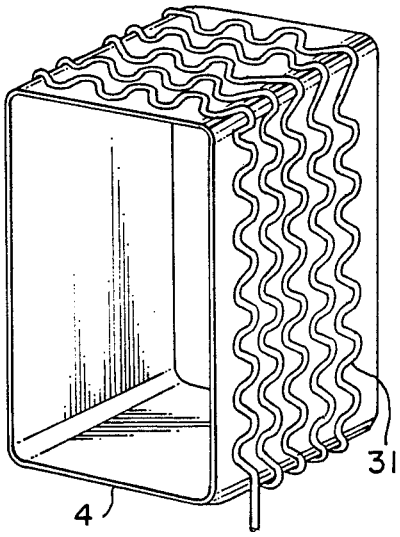
FIG. 7 is a perspective view of an inner box and an evaporating tube according to another embodiment of the present invention.

Evaporating tube 16 is wound around the outer surface of inner box 4 as shown in FIG. 3, and extends substantially straight along the outer surface of inner box 4. Configurations other than this straight wound configuration can also be used. For example, as shown in FIG. 7, an evaporating tube 31 having waves curved along the outer surface of inner box 4 is wound around the inner box and extends along the outer surface thereof.

Figure 4:
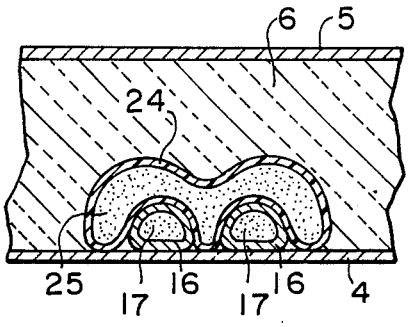
FIG. 4 is an enlarged partial vertical sectional view of the cold preserving container or refrigerator of FIG. 1.
Figure 8:
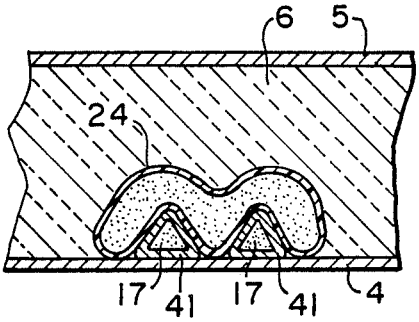
FIG. 8 is a vertical sectional view showing an evaporating tube according to a further embodiment of the present invention.
Figure 9:
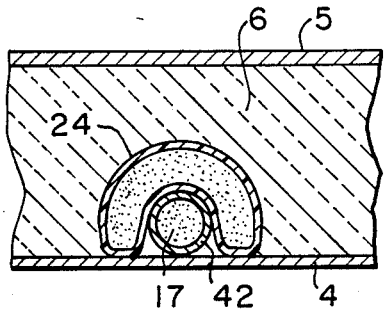
FIG. 9 is a vertical sectional view showing an evaporating tube according to a further embodiment of the present invention.

Although the cross-sectional shape of evaporating tube 16 is shown as a semi-circle in FIG. 4, other shapes can be used. For instance, the cross section of an evaporating tube 41 can form a triangle as shown in FIG. 8, or the cross section of an evaporating tube 42 can form as a circle as shown in FIG. 9.

Figure 5:
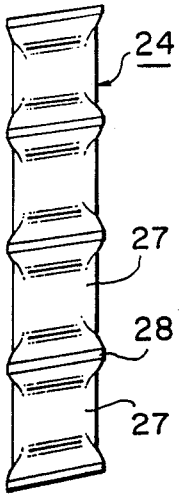
FIG. 5 is a plan view of a cold accumulation means of the cold preserving container or refrigerator of FIG. 1.
Figure 6:
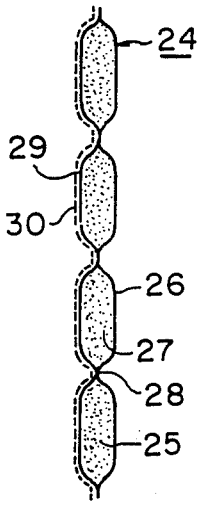
FIG. 6 is a sectional view of the cold accumulation means of FIG. 5.

Cold accumulation components 24 as cold accumulation means are disposed between respective evaporating tubes 16 and heat insulating material 6. Cold accumulation component 24 encloses a cold regenerative material 25 which can accumulate cold. Each cold accumulation component 24 covers evaporating tube 16 and in turn is covered by heat insulating material 6. Cold accumulation component 24 comprises a package 26 constructed from a flexible material, such as a plastic sheet, as shown in FIGS. 5 and 6. Package 26 has a plurality of separate small closed chambers 27. Small closed chambers 27 are formed by heat sealing at portions 28 of the flexible material. Each of the small closed chambers 27 encloses cold regenerative material 25. In this embodiment, the flexible material constituting the surface 29 on the side of evaporating tube 16 includes a high thermal-conducting material, such as aluminium. An adhesive 30 is applied on the surface 29 of package 26 on the side of evaporating tube 16 in this embodiment. Therefore, package 26 functions as an adhesive tape, and evaporating tube 16 can be fixed on the outer surface of inner box 4 by the package as shown in FIGS. 1 and 4.

In the manufacture of the cold preserving container, evaporating tube 16 is first wound around inner box 4. The wound evaporating tube 16 is fixed on the outer surface of inner box 4 by heat accumulation component 24 with adhesive 30. Thereafter or after outer box 5 covers inner box 4, heat insulating material 6 is charged between the inner box and the outer box. Heat insulating material 6 consists of a foamed material, such as foamed polyurethane. The heat insulating material before foaming is charged between inner box 4 and outer box 5. Thereafter the material is foamed to fill the space between inner box 4 and outer box 5. The inner box and the outer box can thus be more strongly connected via the foamed heat insulating material, thereby increasing the rigidity of heat insulating box 2. Moreover, the thickness of heat insulating material 6 can become uniform by the foaming at the position between inner box 4 and outer box 5. The door 3 is then attached to heat insulating box 2, thereby completing the container.

In this cold preserving container, evaporating tube 16 cools both the inside of heat insulating chamber 1 and cold accumulation component 24. Since evaporating tube 16 directly cools cold accumulation component 24 substantially without any air between the tube and the component, the component can be cooled very efficiently. Moreover, as the surface of the component 24 includes a high thermal conducting material, the component can be cooled even more effectively. Therefore, cold regenerative material 25 can be rapidly cooled to the desired temperature, and the material accumulate the cold due to the cooling. Since cold accumulation component 24 is rapidly cooled, excessive cooling of the inside of heat insulating chamber 1 before the temperature of the component reaches a desired temperature can be prevented.

Additionally, since the cold accumulation component 24 is disposed between inner box 4 and outer box 5, the capacity of the component can be easily increased without decreasing the inside space of heat insulating chamber 1. As a result, the cold preserving property of the container can be greatly increased, and the objects contained in the container can be maintained at a low temperature for a long time.

Furthermore, in this embodiment, circulation fan 13 can be driven in accordance with the signal from thermostat 14. The cold air in heat insulating chamber 1 is circulated through cold air circulating path 10, and the air in heat insulating chamber 1 can thereby be substantially uniform. Moreover, the efficiency of the heat exchange between evaporating tube 16 or cold accumulation component 24 and the inside air of heat insulating chamber 1 can be increased by the circulation of the cold air.

Since package 26 constituting cold accumulation component 24 is divided into small closed chambers 27 by heat sealing with constant pitches as shown in FIGS. 5 and 6, the thickness of the cold accumulation component can be substantially uniform by the constant-pitch heat sealing.

According to one embodiment of heat insulating box 2, adhesive 30 is not provided on surface 29 of cold accumulation component 24. In the manufacture of that embodiment evaporating tube 16 after having been wound around inner box 4 is fixed to the outer surface of the inner box a suitable adhesive tape, such as aluminium adhesive tape, and cold accumulation component 24 is then positioned disposed on the fixed evaporating tube. Thereafter the component is fixed on the inner box 4 by a suitable adhesive tape.

Although several preferred embodiments of the present invention have been described herein in detail, it will be appreciated by those skilled in the art that various modifications and alterations can be made to these embodiments without materially departing from the novel teachings and advantages of this invention. Accordingly, it is to be understood that all such modifications and alterations are included within the scope of the invention as defined by the following claims.

What is claimed is:

1. A refrigerator comprising:

an inner box defining at least in part a refrigerator compartment therein, said inner box having an inner box outer surface;

an outer box generally covering said inner box;

cooling means for cooling said refrigerator compartment, said cooling means including an evaporator tubing wound around said inner box outer surface and thereby positioned outside of said refrigerator compartment and through which refrigerant flows, said evaporator tubing directly cooling said refrigerator compartment;

flexible cold accumulator packaging enclosing therein cold regenerative material and covering said evaporator tubing;

heat insulating material disposed between said inner and outer boxes and covering said flexible cold accumulator packaging; and circulating means for circulating cold air in said refrigerator compartment, said circulating means comprising a cold air circulating path formed inside said inner box and in said refrigerator compartment and thereby separated from said evaporator tubing by said inner box, said cold air circulating path having an air inlet at a lower position of the inside of said refrigerator compartment and an air outlet at an upper position of the inside of said refrigerator compartment, a circulation fan having a power circuit and circulating cold air in said refrigerator compartment through said cold air circulating path, and a thermostat which detects the temperature inside of said refrigerator compartment and sends a signal associated with the detected temperature to said power circuit.

2. The refrigerator of claim 1 wherein said flexible cold accumulator packaging is wrapped over to thereby cover said evaporator tubing with said cold regenerative material.

3. The refrigerator of claim 1 wherein said evaporator tubing extends along said inner box outer surface and has waves curved along said outer surface.

4. The refrigerator of claim 1 wherein said packaging has a plurality of small closed separated chambers formed by heat sealing the flexible material of said packaging, and each chamber encloses a portion of said cold regenerative material.

5. The refrigerator of claim 1 wherein said heat insulating material is a foamed material.

6. The refrigerator of claim 1 wherein said inner box, said outer box and said heat insulating material form a refrigerator box having a front surface, and further comprising a door attached to said front surface, moveable between open and closed positions and defining part of said refrigerator compartment.

7. The refrigerator of claim 6 wherein said inner box includes a box wall opposite to said door and said cold air circulating path passes directly along said box wall.

8. The refrigerator of claim 6 wherein said inner box has top and bottom surfaces and said evaporator tubing is wound around on said top and bottom surfaces.

9. The refrigerator of claim 1 wherein said flexible cold accumulator packaging extends continuously over at least adjacent windings of said evaporator tubing.

10. The refrigerator of claim 1 wherein said evaporator tubing spirals about a generally horizontal axis of said inner box.

11. A refrigerator comprising:

an inner box defining at least in part a refrigerator compartment therein, said inner box having an inner box outer surface;

an outer box generally covering said inner box;

cooling means for cooling said refrigerator compartment, said cooling means including an evaporator tubing wound around and thereby encircling said inner box outer surface and through which refrigerant flows, said evaporator tubing directly cooling said refrigerator compartment;

flexible cold accumulator packaging enclosing therein cold regenerative material and covering over said evaporator tubing with said cold regenerative material;

heat insulating material disposed between said inner and outer boxes and covering said flexible cold accumulator packaging; and adhesive on the surface of said packaging on the side of said evaporator tubing.

12. The refrigerator of claim 11 wherein said adhesive fixes said evaporator tubing on said inner box outer surface.

13. The refrigerator of claim 11 wherein said evaporator tubing extends along said inner box outer surface and has waves curved along said outer surface.

14. The refrigerator of claim 11 wherein said packaging has a plurality of small closed separated chambers formed by heat sealing the flexible material of said packaging, and each said chamber encloses a portion of said cold regenerative material.

15. The refrigerator of claim 11 wherein said heat insulating material is a foamed material.

16. The refrigerator of claim 11 wherein said inner box, said outer box and said heat insulating material form a refrigerator box having a front surface, and further comprising a door attached to said front surface, moveable between open and closed positions and defining part of said refrigerator compartment.

17. The refrigerator of claim 16 wherein said inner box has top and bottom surfaces and said evaporator tubing is wound around on said top and bottom surfaces.

18. The refrigerator of claim 11 wherein said flexible cold accumulator packaging extends continuously over at least two adjacent windings of said evaporator tubing.

19. A refrigerator comprising:

an inner box defining at least in part a refrigerator compartment therein, said inner box having an inner box outer surface;

an outer box generally covering said inner box;

cooling means for cooling said refrigerator compartment, said cooling means including an evaporator tubing wound around and thereby encircling said inner box outer surface and through which refrigerant flows, said evaporator tubing directly cooling said refrigerator compartment;

flexible cold accumulator packaging enclosing therein cold regenerative material and covering over said evaporator tubing with said cold regenerative material;

heat insulating material disposed between said inner and outer boxes and covering said flexible cold accumulator packaging;

path means for defining a cold air path in said refrigerator compartment and spaced from said evaporator tubing by said inner box; and circulating means for circulating cold air along the cold air path.

20. The refrigerator of claim 19 wherein said evaporator tubing extends along said inner box outer surface and has waves curved along said outer surface.

21. The refrigerator of claim 19 wherein said packaging has a plurality of small closed separated chambers formed by heat sealing the flexible material of said packaging, and each said chamber encloses a portion of said cold regenerative material.

22. The refrigerator of claim 19 wherein said heat insulating material is a foamed material.

23. The refrigerator of claim 19 wherein said inner box, said outer box and said heat insulating material form a refrigerator box having a front surface, and further comprising a door attached to said front surface, moveable between open and closed positions and forming part of said refrigerator compartment.

24. The refrigerator of claim 23 wherein said inner box includes a box wall opposite to said door and along which said cold air path directly passes.

25. The refrigerator of claim 19 wherein said inner box has top and bottom surfaces and said evaporator tubing is wound around on said top and bottom surfaces.

26. The refrigerator of claim 19 wherein said flexible cold accumulator packaging extends continuously over adjacent windings of said evaporator tubing.

* * * * *